US007419256B2

(12) United States Patent
Niekawa

(10) Patent No.: US 7,419,256 B2
(45) Date of Patent: Sep. 2, 2008

(54) INKJET PRINTER

(75) Inventor: Yukihiro Niekawa, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 398 days.

(21) Appl. No.: 11/033,160

(22) Filed: Jan. 12, 2005

(65) Prior Publication Data

US 2005/0168555 A1 Aug. 4, 2005

(30) Foreign Application Priority Data

Feb. 2, 2004 (JP) ..... 2004-024959

(51) Int. Cl.
*B41J 2/01* (2006.01)
*B41J 29/38* (2006.01)
*B41J 29/393* (2006.01)

(52) U.S. Cl. ..... 347/102; 347/14; 347/19

(58) Field of Classification Search ..... 347/102, 347/5, 14, 16, 17, 19
See application file for complete search history.

(56) References Cited

U.S. PATENT DOCUMENTS 6,522,350 B2 * 2/2003 Inoue et al. ..... 347/238
6,522,844 B2 * 2/2003 Yamane et al. ..... 399/67
7,055,945 B2 * 6/2006 Yoneyama et al. ..... 347/102
7,131,722 B2 * 11/2006 Yoneyama et al. ..... 347/102
7,182,448 B2 * 2/2007 Godil et al. ..... 347/88
2003/0222961 A1 * 12/2003 Nakajima ..... 347/102

FOREIGN PATENT DOCUMENTS

JP 03151239 A * 6/1991
JP 06019563 A * 1/1994
JP 2001-310454 11/2001

* cited by examiner

*Primary Examiner*—Stephen D Meier
*Assistant Examiner*—Leonard S Liang
(74) *Attorney, Agent, or Firm*—Finnegan, Henderson, Farabow, Garrett & Dunner, L.L.P.

(57) ABSTRACT

An inkjet recording apparatus includes: a conveyance device for moving a recording medium P in a predetermined direction; a recording device for recording an image on the recording medium P by using an ink cured by photo irradiation; light irradiating devices for irradiating light to the ink landed on the recording medium P; sensors for detecting illumination intensity of the light irradiated from each of the light irradiating devices; and a controller for controlling each of the conveyance device, the recording device, the light irradiating devices, and the sensors, wherein the controller controls the illumination intensities of the light irradiating devices so that the illumination intensities are substantially the same as each other, in accordance with the light irradiating device having the lowest illumination intensity.

32 Claims, 5 Drawing Sheets

INKJET PRINTER

BACKGROUND OF THE INVENTION

1. Field of the Invention

The present invention is related to an inkjet recording apparatus, in particular, an inkjet recording apparatus for curing an ink landed on a recording medium, by photo irradiation.

2. Description of Related Art

Conventionally, an inkjet recording apparatus has been known as the recording device capable of printing for various recording media including plain paper. The inkjet recording apparatus is the recording apparatus for forming an image on a recording medium by directly discharging an ink which is a color material from a nozzle placed on a side of a recording head facing the recording medium, and landing, infiltrating or fixing the ink on the recording medium. The inkjet recording apparatus has characteristic superiority in the simplicity of a process, the silence in printing, and the quality of printing texts and pictures.

As the inkjet recording apparatus, there is the apparatus where, for example, a serial head system which forms an image by moving a recording head back and forth on a recording medium and conveying the recording medium in the direction perpendicular to the scan direction of the recording head, and a line head system which comprises a recording head and forms an image by conveying a recording medium in the direction perpendicular to the direction of recording width of the recording medium, the recording head fixed and comprising a nozzle array extending across the recording width of the recording medium, is adopted.

In late years, in the case where image recording is performed by using an inkjet recording apparatus, materials without ink absorption characteristics such as resin or metal have been used as recording media. In addition, in order to fix an ink to such recording medium, a photo curable ink is often used.

A light irradiating device for curing an ink is usually placed in the inkjet recording apparatus using the photo curable ink. When an image is recorded on the recording medium, the ink is cured and fixed by irradiating the ultraviolet rays from a light source which the light irradiating device comprises, in the condition of certain irradiation time and the number of times of irradiation where the ink can be cured, just after the ink has been landed on the recording medium (refer to, for example, JP-Tokukai 2001-310454 A).

SUMMARY OF THE INVENTION

An object of the present invention is to provide an inkjet recording apparatus which can continuously perform appropriate image recording even when the illumination intensities of some light irradiating devices are decreased.

More preferably, an object of the present invention is to provide an inkjet recording apparatus which can prevent the deterioration of a recording medium or an ink.

According to a first aspect of the present invention, an image recording apparatus, comprises:

a recording head which discharges a photo curable ink, which is cured by photo irradiation;

a first light irradiating device and a second light irradiating device which irradiate the photo irradiation to the photo curable ink on a recording medium, and each of which includes a light source;

a detector which detects an illumination intensity of each light irradiating device;

a judgment section which judges whether a difference between a first illumination intensity of the first light irradiating device and a second illumination intensity of the second light irradiating device is more than a predetermined value based on a result of detection by the detector or not; and a controller which controls at least one of the first light irradiating device and the second light irradiating device so that the first illumination intensity and the second illumination intensity are substantially or exactly same, when the judgment section judges the difference is more than the predetermined value.

According to a second aspect of the present invention, an image recording apparatus, comprises:

a recording head which discharges a photo curable ink, which is cured by photo irradiation;

a plurality of light irradiating devices which irradiate the photo irradiation to the photo curable ink on a recording medium, and each of which includes a light source;

a detector which detects an illumination intensity of each light irradiating device; and a controller which controls at least one of the light irradiating devices so that largest illumination intensity in one of the light irradiating devices becomes substantially or exactly same as lowest illumination intensity of another light irradiating device.

According to a third aspect of the preset invention, an image recording apparatus, comprises:

a recording head which discharges a photo curable ink, which is cured by photo irradiation;

a light irradiating device which irradiates the photo irradiation to the photo curable ink on a recording medium, and includes a plurality of light sources;

a detector which detects an illumination intensity of each of the light sources;

a judgment section which judges whether a difference between the illumination intensities of the light sources is more than a predetermined value based on a result of detection by the detector or not; and a controller which controls at least one of the light sources so that each illumination intensity is substantially or exactly same, when the judgment section judges the difference is more than the predetermined value.

According to a fourth aspect of the present invention, an image recording apparatus, comprises:

a recording head which discharges a photo curable ink, which is cured by photo irradiation;

a light irradiating device which irradiates the photo irradiation to the photo curable ink on a recording medium, and includes a plurality of light sources;

a detector which detects an illumination intensity of each of the light sources; and a controller which controls at least one of the light sources so that largest illumination intensity in one of the light sources becomes substantially or exactly same as lowest illumination intensity of another light source.

BRIEF DESCRIPTION OF THE DRAWINGS

The present invention will become more fully understood from the detailed description given hereinafter and the accompanying drawings given by way of illustration only, and thus are not intended as a definition of the limits of the present invention, and wherein.

PREFERRED EMBODIMENTS OF THE INVENTION

In the following, the best mode for carrying out the present invention will be described with reference to the drawings. In the embodiments described below, various kinds of technically preferable limitations are provided in order to carry out the present invention. However, the scope of the invention is not limited to the following embodiments and illustrated examples.

First Embodiment

Figure 1:
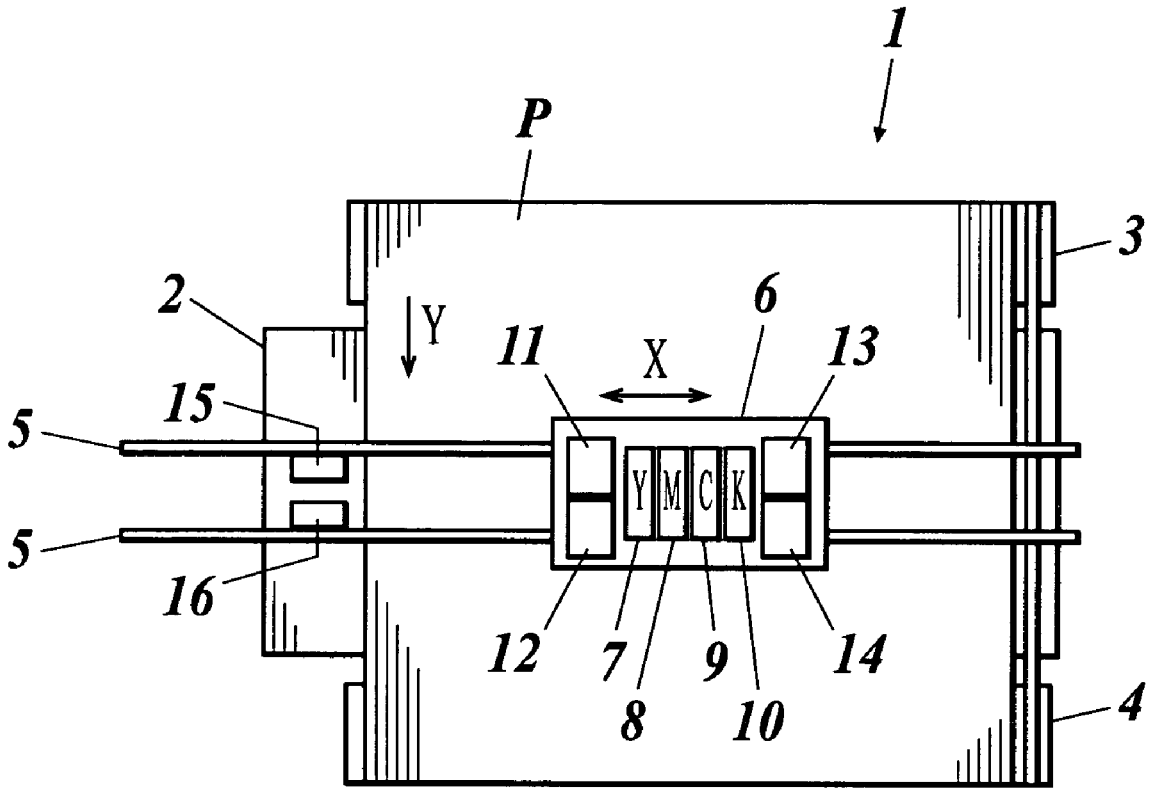
FIG. 1 is a plan view showing a main part of a first embodiment of an inkjet recording apparatus related to the present invention.

The first embodiment of the present invention will be described with reference to FIG.1 to FIG. 3. Each of configuration members of the inkjet recording apparatus 1 in the present embodiment is covered by a housing not shown in the figures. As shown in FIG. 1, a planar platen 2 for supporting a recording medium P from a non-recording surface is placed in the housing. Further, conveyance rollers 3 and 4 are placed in front and back of the platen 2 respectively. Each of the conveyance rollers 3 and 4 rotates in a predetermined direction around a central axis, in front and back of the platen 2. The recording medium P is conveyed from the upstream side to the downstream side in the state where the non-recording surface thereof is supported by the platen 2, in accordance with the rotation direction of each of the conveyance rollers 3 and 4. Here, the conveyance direction of the recording medium P is defined as a sub scan direction Y.

Above the platen 2, long guide rails 5 extending in the direction perpendicular to the sub scan direction Y are placed. Here, the direction where the guide rails 5 extend is defined as a main scan direction X. A carriage 6 is supported by the guide rails 5, and can move back and forth in the main scan direction X while guided by the guide rails 5.

On the carriage 6, four recording heads 7, 8, 9 and 10 may be available for discharging the ink having process colors of Y (Yellow) M (Magenta), C (Cyan) and K (Black) respectively, toward the recording surface of the recording medium P. These recording heads 7, 8, 9 and 10 follow the back-and-forth movement of the carriage 6. In addition, on the discharging surface of each of the recording heads 7, 8, 9 and 10, a lot of nozzles (not shown) may be available for discharging the ink as ink drops are arranged.

Two ultraviolet rays irradiating devices are arranged in line along the sub scan direction Y, for each of left and right ends in the main scan direction X of the carriage 6. That is, in total, four ultraviolet rays irradiating devices 11, 12, 13 and 14 are mounted. These ultraviolet rays irradiating devices 11, 12, 13 and 14 also follow the back-and-forth movement of the carriage 6, same as the recording heads 7, 8, 9 and 10. In each of the ultraviolet rays irradiating devices 11, 12, 13 and 14, an ultraviolet rays source (not shown) for irradiating the ultraviolet rays is placed. Each of the ultraviolet rays irradiating devices 11, 12, 13 and 14 can irradiate the ultraviolet rays toward the recording surface of the recording medium P by turning on the ultraviolet rays source.

Incidentally, a high pressure mercury lamp, a metal halide lamp, a black light, a cold cathode tube, a LED (Light Emitting Diode) or the like can be applied to the ultraviolet rays source.

The carriage 6 can move to a home position arranged on a side in the main scan direction X of platen 2. When the inkjet recording apparatus 1 does not perform recording, the carriage 6 waits for the recording operation, at the home position. In this home position, Sensors 15 and 16 for detecting the illumination intensities of the ultraviolet rays irradiated from the ultraviolet rays irradiating devices 11, 12, 13 and 14 are placed.

Figure 2:
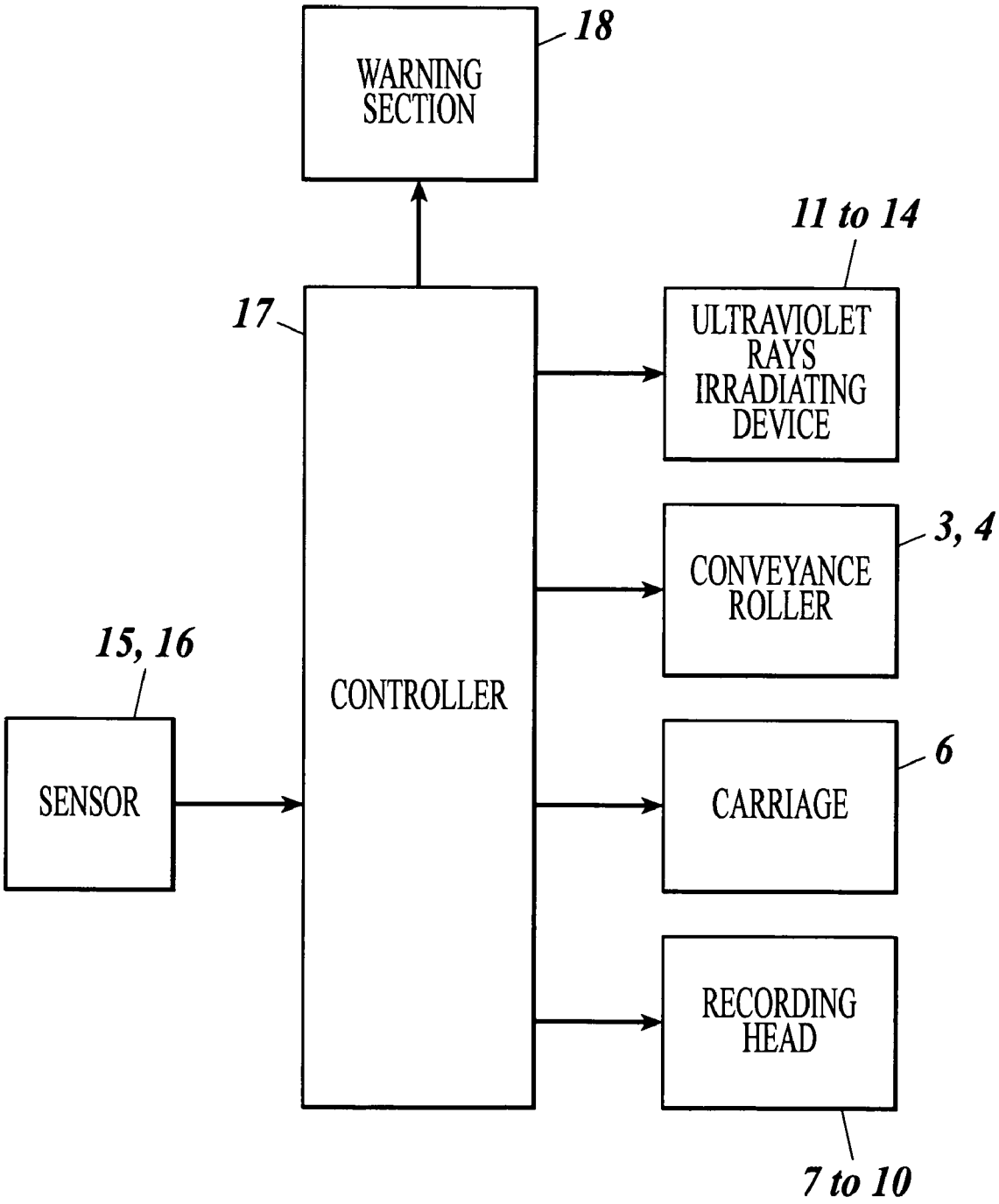
FIG. 2 is a block diagram showing the configuration of a controller of the first embodiment of the inkjet recording apparatus related to the present invention.
Figure 3A:
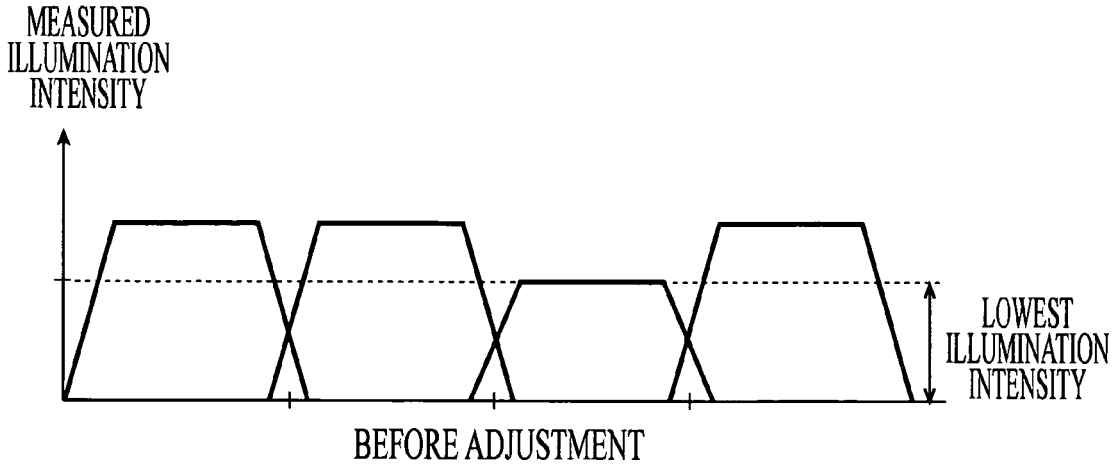
FIG. 3 is a diagram showing the illumination intensity of each ultraviolet rays irradiating device before and after the adjustment by the controller that the inkjet recording apparatus related to the present invention comprises.
Figure 3B:
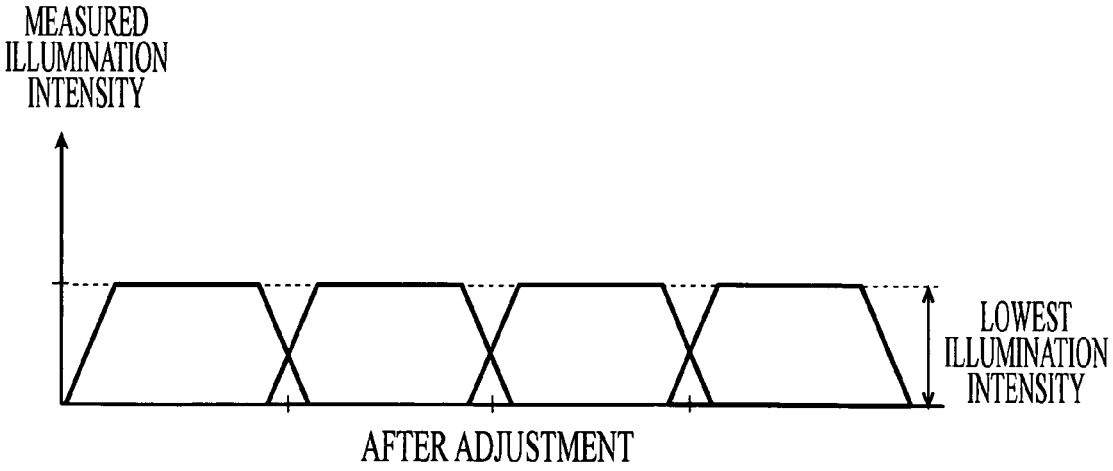

In addition, as shown in FIG. 2, a controller 17 is placed in the inkjet recording apparatus 1 comprising the above configuration. The sensors 15 and 16, and a warning section 18 are connected to the controller 17. Further, the controller 17 is connected to the ultraviolet rays irradiating devices 11, 12, 13 and 14, the conveyance rollers 3 and 4, the carriage 6, and the recording heads 7, 8, 9 and 10, via a drive circuit (not shown). The controller 17 can change the illumination intensities of the ultraviolet rays irradiated from the ultraviolet rays irradiating devices 11, 12, 13 and 14, the moving speed and the number of times of the movement of the carriage 6, the number of the nozzles and the dot intervals of the recording heads 7, 8, 9 and 10, based on detection signals of the sensors 15 and 16.

The warning section 18 issues warning depending on the illumination intensities of the ultraviolet rays irradiated from the ultraviolet rays irradiating devices 11, 12, 13 and 14. A display panel, a warning buzzer or the combination of them can be applied to the warning section 18.

Incidentally, the controller 17 may determine whether or not the illumination intensities detected by the sensors 15 and 16 are lower than the illumination intensity with which the apparatus can show the original performance. Further, in the case where the controller 17 determines that the illumination intensities detected by the sensors 15 and 16 are lower than the illumination intensity with which the apparatus can show the original performance, the warning section 18 may perform processing for issuing the warning of the decrease of the productivity. As the concrete examples, processing for displaying warning messages on the display panel, processing for sounding the warning buzzer or the like can be cited. In addition to that, processing for displaying measured values or processing for displaying the lack of the illumination intensity may be performed. Here, the illumination intensity with which the apparatus can show the original performance means the illumination intensity with which an ink can be sufficiently cured without the control by the controller.

In addition, the controller 17 may determined whether or not the illumination intensities detected by the sensors 15 and 16 are lower than the illumination intensity (hereinafter, the lowest illumination intensity) of the ultraviolet rays minimum required for curing an ink. In the case where the controller 17 determines that the illumination intensities detected by the sensors 15 and 16 are lower than the lowest illumination intensity, the warning section 18 may display the warning of necessity of parts replacement or cleaning. In addition, in the case where the determination is performed before the recording operation by the recording heads 7, 8, 9 and 10, the start of the recording operation may be prohibited to perform the warning by the warning section 18. Further, in the case where the determination is performed in the recording operation, the recording operation may be stopped to perform the warning by the warning section 18.

Incidentally, the warning section 18 may only display the warning of the necessity of the parts replacement or the cleaning to continue the recording operation, without prohibiting the recording operation.

As for the ink, it is possible to use the ink meeting the description in "Curing System Using Photoacid and Photobase Generator (Section 1)", "Photoinduced Type Alternating Copolymerization (Section 2)" and the like of "Photocuring System (Chapter 4)" of "Photocuring Technology, Selection of Resin and Initiator, and Measurement and Evaluation of Blending Condition and Cure Extent (TECHNICAL INFORMATION INSTITUTE CO., LTD)". The ink cured by normal radical polymerization may be used.

The ink used in the present embodiment is the photo curable ink having the property capable of being cured by the irradiation of the ultraviolet rays as light. The ink includes, as major component, at least a polymerizable compound (including a publicly known polymerizable compound), a photoinitiator and a color material. However, in the case where the ink meeting the above "Photoinduced Type Alternating Copolymerization (Section 2)", the photoinitiator may not be included.

The above photo curable ink is roughly classified into a radical polymerization system ink including a radical polymerizable compound as the polymerizable compound, and a cationic polymerization system ink including a cationic polymerizable compound as the polymerizable compound. Both the types of the ink can be respectively applied as the ink used in the present embodiment. Further, a hybrid type ink obtained by compounding the radical polymerization system ink and the cationic polymerization system ink may be also applied as the ink used in the present embodiment. However, the cationic polymerization system ink having a little or no inhibitory effect of polymerization reaction by oxygen is superior in the functionality and the versatility. Therefore, in particular, it is preferable to use the cationic polymerization system ink.

As the recording medium P, various types of paper such as plain paper, regenerated paper, and glossy paper, each of which is applied to a normal inkjet printer, various types of textile, various types of nonwoven fabric, and recording media made of material such as resin, can be applied. As the shape of the recording medium P, roll shape, cut-sheet shape, plate shape or the like can be applied. As the recording medium P used in the present embodiment, a long resin film rolled in roll shape is used.

Further, as the recording medium P, a transparent or an opaque non-absorption nature resin film used for so-called flexible packaging can be applied. As the concrete resin type of the resin film, polyethylene terephthalate, polyester, polyolefin, polyamide, polyesteramide, polyether, polyimide, polyamideimide, polystyrene, polycarbonate, poly-p-phenylenesulfide, polyetherester, polyvinylchloride, poly(meta) acrylate, polyethylene, polypropylene, nylon or the like can be applied. Further, the copolymer of these resins, the mixture of these resins, the crosslinking of these resins or the like can be also applied. In particular, it is preferable to select any of the polyethylene terephthalate, the polystyrene, the polypropylene or the nylon, which are elongated, in terms of the transparency, the dimensional stability, the stiffness, the environmental burden, the cost or the like of the resin film. In addition, it is preferable to use the resin film having thickness of 2 to 100 μm (preferably, 6 to 50 μm).

Incidentally, surface treatment such as corona discharge treatment, pre-treatment or the like may be carried out on the surface of a support of the resin film.

Next, the action of the present embodiment will be described.

When predetermined image information has been sent to the controller 17 of the inkjet recording apparatus 1, each of the conveyance rollers 3 and 4 repeats predetermined rotation and stopping thereof. In addition, the recording medium P is intermittently conveyed over the platen 2 in the sub scan direction Y, in the state where the non-recording surface is supported by the platen 2.

The carriage 6 activates to move back and forth over the recording medium P in the main scan direction X, for every stopping of each of conveyance rollers 3 and 4. Accordingly, the recording heads 7, 8, 9 and 10 and the ultraviolet rays irradiating devices 11, 12, 13 and 14 also move back and forth over the recording medium P so as to follow the movement of the carriage 6. The inks having predetermined colors are discharged from the nozzles of the recording heads 7, 8, 9 and 10 toward the recording medium P, respectively. In addition, the ultraviolet rays source placed in each of the ultraviolet rays irradiating device 11, 12, 13 and 14 is turned on. Thereby, just after the ink discharged from each of the recording heads 7, 8, 9 and 10 has been landed on the recording surface of the recording medium P, the ultraviolet rays are irradiated from the ultraviolet rays source to the ink. Further, the ink to which the ultraviolet rays are irradiated is cured and fixed on the recording surface of the recording medium P.

From then on, the inkjet recording apparatus 1 repeats each of the above operations, so that predetermined images comprising a plurality of dots are sequentially recorded on the recording surface of the recording medium P.

At this time, in the inkjet recording apparatus 1 in the present embodiment, the carriage 6 moves to the home position for every recording of a predetermined number of images. When the carriage 6 has moved to the home position, the ultraviolet rays sources placed in the ultraviolet rays irradiating devices 11, 12, 13 and 14 are turned on to irradiate the ultraviolet rays.

After that, each of the sensors 15 and 16 detects the illumination intensity of the ultraviolet rays irradiated from each of the ultraviolet rays irradiating devices 11, 12, 13 and 14. Further, the result of the detection is outputted to the controller 17, as a detection signal. The controller 17 determines an ultraviolet rays irradiating device having the lowest illumination intensity among the ultraviolet rays irradiating devices 11, 12, 13 and 14, based on the detection signals from the sensors 15 and 16. Then, in accordance with the ultraviolet rays irradiating device having the lowest illumination intensity, the controller 17 adjusts the electric current, the electric potential, the PWM (Pulse Width Modulation) or the like of the other ultraviolet rays irradiating devices. Thereby, the controller 17 makes the illumination intensities of the ultraviolet rays irradiating devices 11, 12, 13 and 14 be substantially the same as each other. Preferably, the controller 17 makes the illumination intensities be exactly the same as each other.

At the same time, the controller 17 makes the moving speed of the carriage 6 be slower than a normal moving speed, by outputting a driving signal for slowly moving the carriage 6, to the drive circuit of the carriage 6. Thereby, the controller 17 performs the control for increasing the irradiation time for the ink landed on the recording medium P. By so doing, the irradiation time of the ultraviolet rays irradiated to the ink landed on the recording medium P is extended. Accordingly, it is possible to sufficiently cure the ink.

Incidentally, the controller 17 may decrease the number of nozzles used by the recording heads 7, 8, 9 and 10 from the normal number of them, by outputting a driving signal for decreasing the number of the nozzles used by the recording heads 7, 8, 9 and 10 in one back-and-forth movement of the carriage 6. Thereby, the controller 17 may control the irradiation time. By so doing, an image area recorded on the recording medium P in one back-and-forth movement of the carriage 6 becomes smaller. Further, the irradiation time of the ultraviolet rays irradiated to the ink landed on the recording medium P is extended, by increasing the number of movement of the carriage 6. Accordingly, it is possible to sufficiently cure the ink.

In addition, the controller 17 may extend the interval among the dots along the moving direction of the carriage 6 among the dots formed by the recording heads 7, 8, 9 and 10 for every movement of the carriage 6 along the forward path or the return path, by outputting driving signals for extending the interval among the dots along the moving direction of the carriage 6 among the dots formed by the recording heads 7, 8, 9 and 10 for every movement of the carriage 6 along the forward path or the return path. Thereby, the controller 17 may control the irradiation time. To put it concretely, in the case of the image having the resolution where the recording is performed to all the necessary pixels in one scan of the carriage in a normal recording mode, the amount of skipping of the pixels to be recorded in one scan of the carriage is adjusted, and the number of the pixels to be recorded in one scan of the carriage 6 is changed to the half thereof. Accordingly, two scans of the carriage are performed in order to record the image having the same resolution as the image in the case without the skipping. As a result, the number of times of the irradiation of the ultraviolet rays from the ultraviolet rays irradiating devices 11, 12, 13 and 14 mounted in on the carriage 6 also becomes two. Further, according to the increase of the amount of skipping of the pixels to be recorded by one nozzle in one scan of the carriage 6, it is possible to increase the amount of ultraviolet rays irradiated from the ultraviolet rays irradiating devises 11, 12, 13 and 14 to the ink landed on the recording medium P.

Incidentally, when the number of pixels to be recorded in one scan of the carriage 6 is changed to the one third thereof, by further increasing the amount of skipping of the pixels to be recorded in one scan of the carriage 6, three scans of carriage 6 are performed in order to record the image having the same resolution as the image in the case without the skipping. Therefore, the number of times of the irradiation of the ultraviolet rays from the ultraviolet rays irradiating devices 11, 12, 13 and 14 also becomes three. Further, when the number of pixels to be recorded in one scan of the carriage 6 is changed to the one fourth thereof, by still further increasing the amount of skipping of the pixels to be recorded in one scan of the carriage 6, four scans of carriage 6 are performed in order to record the image having the same resolution as the image in the case without the skipping. Therefore, the number of times of the irradiation of the ultraviolet rays from the ultraviolet rays irradiating devices 11, 12, 13 and 14 also becomes four. By so doing, the image area recorded on the recording medium P in one back-and-forth movement of the carriage 6 becomes smaller. Further, the irradiation time of the ultraviolet rays irradiated to the ink landed on the recording medium P is extended, by increasing the number of movement of the carriage 6. Accordingly, it is possible to sufficiently cure the ink.

As above, according to the inkjet recording apparatus in the present embodiment, in the case where the illumination intensities of some ultraviolet rays irradiating devices are decreased in the serial print type inkjet recording apparatus 1, the illumination intensities of the ultraviolet rays irradiating devices 11, 12, 13 and 14 are controlled by the controller 17, so as to be substantially the same as the illumination intensity of the ultraviolet rays irradiating device having the lowest illumination intensity among the ultraviolet rays irradiating devices 11, 12, 13 and 14. Accordingly, the irradiation time is controlled so that the accumulated amounts of light irradiated from the ultraviolet rays irradiating devices 11, 12, 13 and 14 to the certain part of the recording medium P are substantially the same as each other. Therefore, it is possible to prevent an excessive amount of the irradiation from a normal ultraviolet rays irradiating device the illumination intensity of which is not decreased. Thereby, it is possible to continuously perform appropriate image recording, even when some ultraviolet rays irradiating devices are deteriorated or contaminated. In addition, it is possible to prevent the deterioration of the recording medium P or the ink caused by excessive light or heat. Further, it is possible to extend the life of the normal ultraviolet rays irradiating device of which electric power consumption and the illumination intensity are not decreased.

In addition, in the case where the illumination intensities of the ultraviolet rays irradiated from the ultra violet rays irradiating devices 11, 12, 13 and 14 become lower than the lowest illumination intensity, the warning section 18 issues the warning. Thereby, it is possible to let a user recognize the current illumination intensity does not meet the illumination intensity necessary for the curing of the ink. By so doing, it is possible to urge the user to perform the maintenance or the replacement of the ultraviolet rays irradiating devices 11, 12, 13 and 14.

Second Embodiment

The second embodiment of the present invention will be described with reference to FIG. 4 and FIG. 5. In the present embodiment, the configuration of the recording apparatus, the light irradiating device and the controller is different, in comparison to that of the first embodiment. Further, the configuration other than the above, including the ink and the recording medium is the same as that of the first embodiment. Therefore, in the present embodiment, the recording apparatus, the light irradiating device and the controller are mainly described. Further, the detail description of the same configuration as the first embodiment will be omitted by applying the same reference letters.

Figure 4:
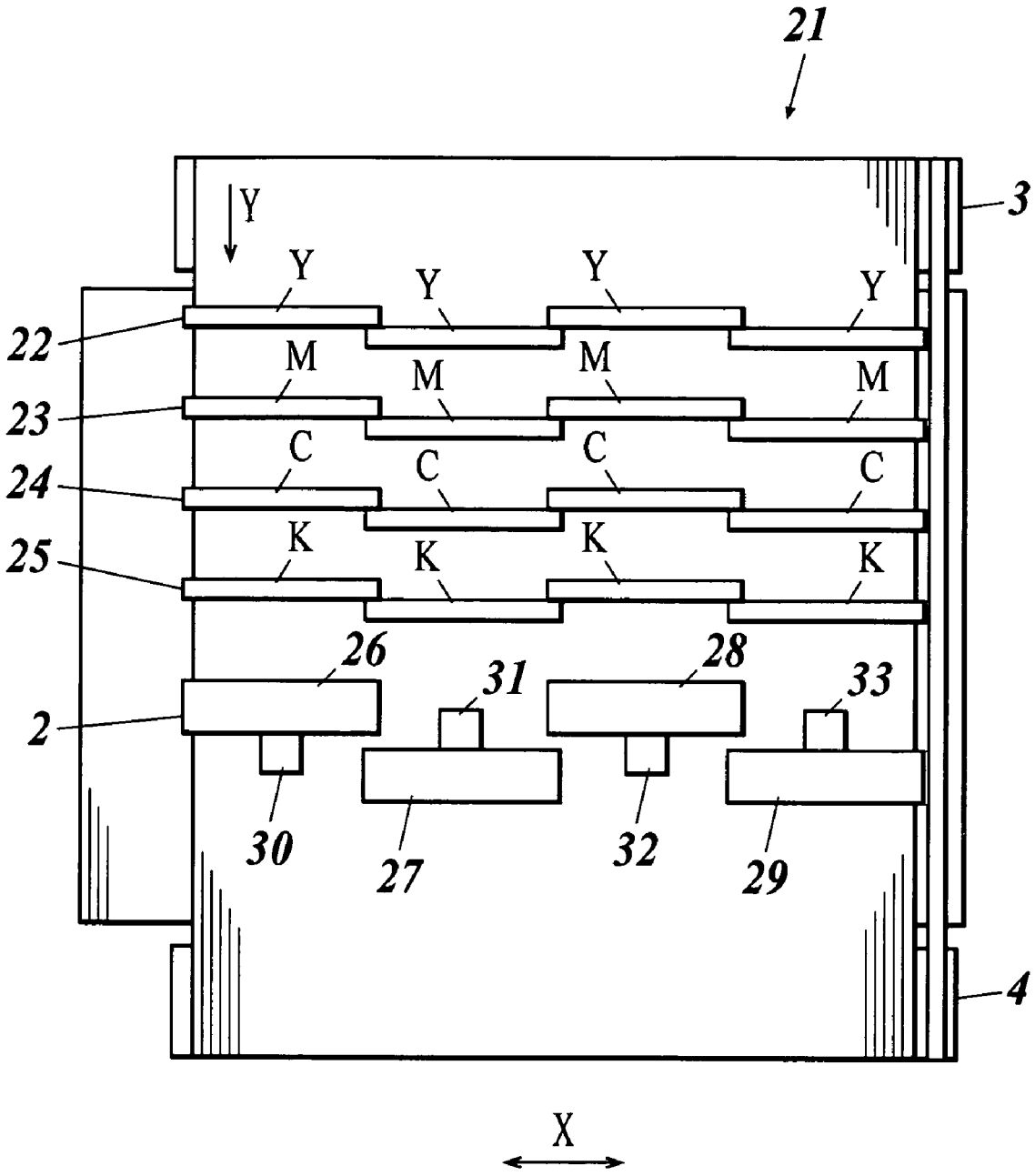
FIG. 4 is a plan view showing a main part of a second embodiment of the inkjet recording apparatus related to the present invention.

As shown in FIG. 4, an inkjet recording apparatus 21 comprises a platen 2. Above this platen 2, four line heads 22, 23, 24 and 25 for discharging inks having process colors of Y, M, C and K respectively toward the recording surface of the recording medium P are placed from the upstream side to the downstream side in the conveyance direction of the recording medium P. Each of the line heads 22, 23, 24 and 25 extends across the approximate full width of the recording medium P in the direction perpendicular to the conveyance direction of the recording medium P. Further, on the discharging surface of each of the line heads 22, 23, 24 and 25, a lot of nozzles (not shown) for discharging the ink as ink drops are arranged. Here, the conveyance direction of the recording medium P is defined as a conveyance direction Y, and the direction where the line heads 22, 23, 24 and 25 extend is defined as an extension direction X.

On the most downstream side in the conveyance direction Y of the recording medium P, four ultraviolet rays irradiating devices 26, 27, 28 and 29 are arranged in line along the extension direction X. In each of the ultraviolet rays irradiating devices 26, 27, 28 and 29, an ultraviolet rays source (not shown) for irradiating the ultraviolet rays is placed. Each of the ultraviolet rays irradiating devices 26, 27, 28 and 29 can irradiate the ultraviolet rays toward the recording surface of the recording medium P, by turning on the ultraviolet rays source.

Incidentally, a high pressure mercury lamp, a metal halide lamp, a black light, a cold cathode tube, a LED or the like can be applied to the ultraviolet rays source.

Further, the ultraviolet rays irradiating devices 26, 27, 28 and 29 may be arranged so as to extend across the approximate full width of the recording medium P on the downstream side in the conveyance direction Y of the line heads 22, 23, 24 and 25, respectively.

Each of the ultraviolet rays irradiating devices 26, 27, 28 and 29 can move up and down. On the upstream side or the downstream side in the conveyance direction Y of the ultraviolet rays irradiating devices 26, 27, 28 and 29, four sensors 30, 31, 32 and 33 for detecting the illumination intensities of the ultraviolet rays irradiated from the ultraviolet rays irradiating devices 26, 27, 28 and 29 are arranged respectively. These sensors 30, 31, 32 and 33 can move along the extension direction X.

Figure 5:
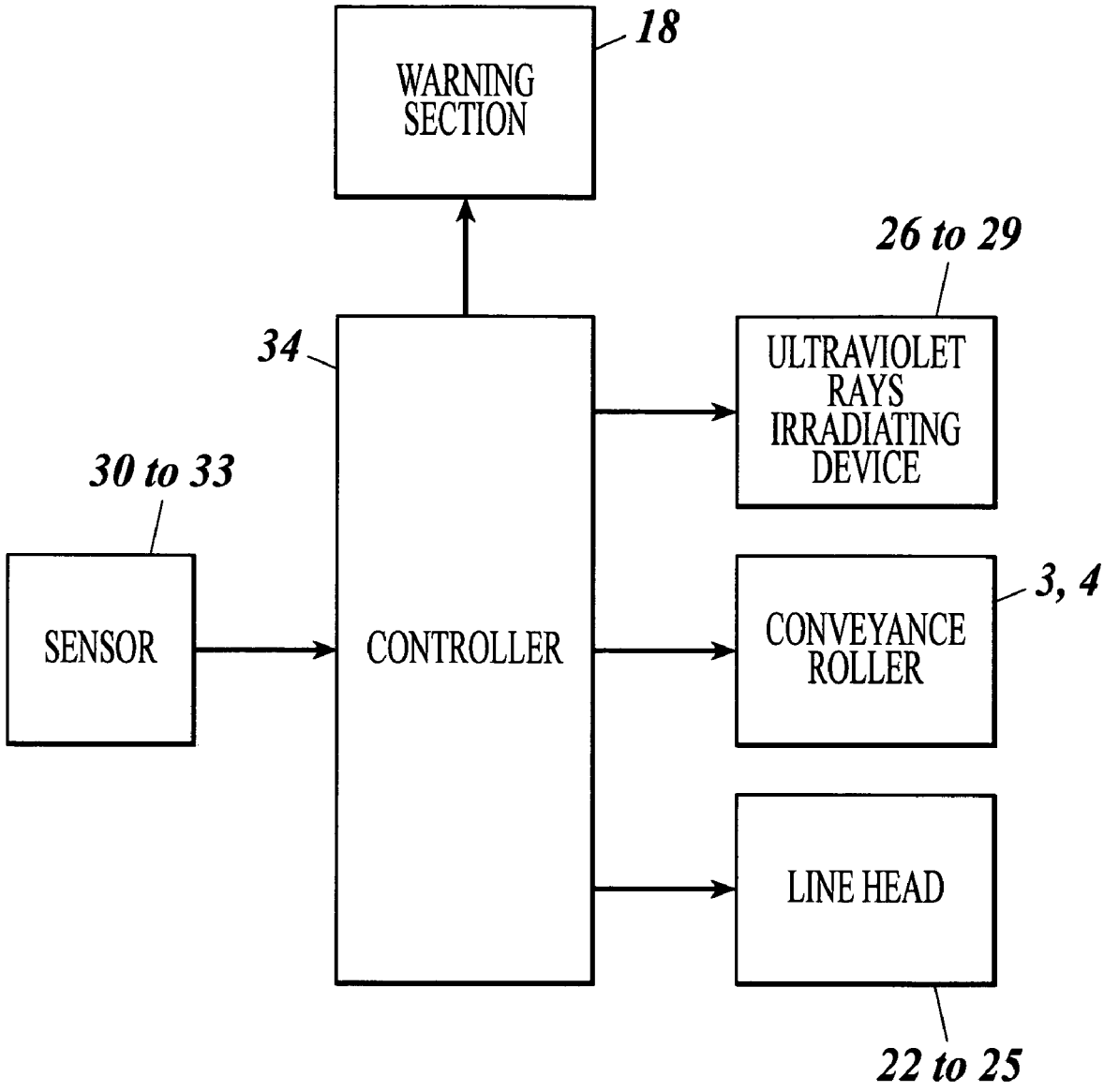
FIG. 5 is a block diagram showing a configuration of a controller of the second embodiment of the inkjet recording apparatus related to the present invention.

In addition, as shown in FIG. 5, a controller 34 for controlling the operation of each configuration member is placed in the inkjet recording apparatus 21 comprising the above configuration. The above sensors and the warning section 18 are connected to the controller 34. Further, the controller 34 is connected to the ultraviolet rays irradiating devices 26, 27, 28 and 29, the conveyance rollers 3 and 4, and the line heads 22, 23, 24 and 25, via a drive circuit. The controller 34 can change the illumination intensities of the ultraviolet rays irradiated from the ultraviolet rays irradiating devices 26, 27, 28 and 29, and the rotating speed of the conveyance rollers 3 and 4, based on detection signals of the sensors 30, 31, 32 and 33.

Next the action of the present embodiment will be described.

When predetermined image information has been sent to the controller 34 of the inkjet recording apparatus 21, the conveyance rollers 3 and 4 rotate. In addition, the recording medium P is continuously conveyed over the platen 2 in the conveyance direction Y, in the state where the non-recording surface is supported by the platen 2.

In this state, the inks having required color are discharged from the nozzles of the four line heads 22, 23, 24 and 25. In addition, the ultraviolet rays source placed in each of the ultraviolet rays irradiating devices 26, 27, 28 and 29 is turned on. Thereby, the ink discharged from each of the line heads 22, 23, 24 and 25 is irradiated by the ultraviolet rays from the ultraviolet rays source, after the ink has passed the line head 25 placed on the most downstream side in the conveyance direction Y. And then, the ink irradiated by the ultraviolet rays is cured and fixed on the recording surface of the recording medium P.

From then on, the inkjet recording apparatus 21 repeats each of the above operations, so that predetermined images comprising a plurality of dots are sequentially recorded on the recording surface of the recording medium P.

At this time, in the inkjet recording apparatus in the present embodiment, the ultraviolet rays irradiating devices 26, 27, 28 and 29 move up for every recording of the predetermined number of images. In addition, the sensors 30, 31, 32 and 33 detect the illumination intensities of the ultraviolet rays of the ultraviolet rays irradiating devices 26, 27, 28 and 29, while moving just under the ultraviolet rays irradiating devices 26, 27, 28 and 29 in the extension direction X, respectively.

After that, when each of the sensors 30, 31, 32 and 33 has detected the illumination intensity of the ultraviolet rays irradiated form each of the ultraviolet rays irradiating devices 26, 27, 28 and 29, the result of the detection is outputted to the controller 34, as a detection signal. The controller 34 determines an ultraviolet rays irradiating device having the lowest illumination intensity among the ultraviolet rays irradiating devices 26, 27, 28 and 29, based on the detection signal from each of the sensors 30, 31, 32 and 33. Then, in accordance with the ultraviolet rays irradiating device having the lowest illumination intensity, the controller 34 adjusts the electric current, the electric potential, the PWM (Pulse Width Modulation) or the like of the other ultraviolet rays irradiating devices. Thereby, the controller 34 makes the illumination intensities of the ultraviolet rays irradiating devices 26, 27, 28 and 29 be substantially the same as each other. Preferably, the controller 34 makes the illumination intensities be exactly the same as each other.

At the same time, the controller 34 makes the rotating speed of the conveyance rollers 3 and 4 be slower than a normal rotating speed, by outputting a driving signal for slowly rotating the conveyance rollers 3 and 4, to the drive circuit of the conveyance rollers 3 and 4. Thereby, the controller 34 performs the control for increasing the irradiation time for the ink landed on the recording medium P. By so doing, the irradiation time of the ultraviolet rays irradiated to the ink landed on the recording medium P is extended. Accordingly, it is possible to sufficiently cure the ink.

As above, according to the inkjet recording apparatus in the present embodiment, in the case where the illumination intensities of some ultraviolet rays irradiating devices are decreased in the line print type inkjet recording apparatus 21, the illumination intensities of the ultraviolet rays irradiating devices 26, 27, 28 and 29 are controlled by the controller 34, so as to be substantially the same as the illumination intensity of the ultraviolet rays irradiating device having the lowest illumination intensity among the ultraviolet rays irradiating devices 26, 27, 28 and 29. Accordingly, the irradiation time is controlled so that the accumulated amounts of light irradiated from the ultraviolet rays irradiating devices 26, 27, 28 and 29 to the certain part of the recording medium P are substantially the same as each other. Therefore, it is possible to prevent an excessive amount of the irradiation from a normal ultraviolet rays irradiating device the illumination intensity of which is not decreased. Thereby, it is possible to continuously perform appropriate image recording, even when some ultraviolet rays irradiating devices are deteriorated or contaminated. In addition, it is possible to prevent the deterioration of the recording medium P or the ink caused by excessive light or heat. Further, it is possible to extend the life of the normal ultraviolet rays irradiating device of which electric power consumption and the illumination intensity are not decreased.

Incidentally, the present embodiment is described by using the example where an exposure device is configured by arranging the ultraviolet rays irradiating devices 26, 27, 28 and 29 which are a plurality of light irradiating devices, in linear groups. However, the present invention is not limited to this example.

For example, an exposure device may comprise a single light irradiating device, and the light irradiating device may comprise a plurality of light sources. In this case, it is possible to detect the illumination intensity of the irradiated light for every light source, and control image recording operation based on the result of the detection.

In addition, the first and the second embodiments are described by using the example where the illumination intensities of the ultraviolet rays irradiating devices other than the ultraviolet rays irradiating device having the lowest illumination intensity is controlled so as to be substantially the same as the lowest illumination. However, the present invention is not limited to this example.

That is, it is possible to continuously perform the image recording without variation, by comprising: a sensor which detects the illumination intensities of the light irradiated form a plurality of light irradiating devices or a plurality of light sources; and a controller which controls the illumination intensities of the light irradiated from the plurality of light irradiating devices or the plurality of light sources so as to make the illumination intensities be the same as each other, in the case where it is determined that the difference among the illumination intensities of the irradiated light detected by the sensor is larger than a predetermined value.

Therefore, in the case where partial variation of the illumination intensity of the exposure device is occurred simply because of contamination or the like, it is possible to continuously perform the image recording without variation, also by controlling each of the illumination intensity of the light irradiated from the plurality of light irradiating devices or the plurality of light sources so as to be substantially the same as the illumination intensity of factory default.

In addition, the first and the second embodiments are described by using the example where the conveyance speed of the recording medium P is decreased to perform the control for increasing the irradiation time for the ink landed on the recording medium P is irradiated. However, the present invention is not limited to this example.

That is, it is only necessary that the irradiation time for the ink landed on the recording medium P is controlled based on the illumination intensity of each light, in the state where the illumination intensities of light irradiated from the plurality of light irradiating devices are controlled so as to be substantially the same as each other.

Incidentally, as for the control of the irradiation time, it is only necessary that the inkjet recording apparatus comprises a moving device for moving the recording medium and the exposure device relatively each other, and the controller controls the irradiation time by decreasing the relative moving speed of the recording medium P and the exposure device.

Further, in the case where the inkjet recording apparatus does not comprise the moving device, it is only necessary that the irradiation time is controlled by increasing the exposure time of the exposure device.

The entire disclosure of Japanese Patent Application No. Tokugan 2004-024959 filed on Feb. 2, 2004 including specification, claims, drawings and summary are incorporated herein by reference in its entirety.

What is claimed is:

1. An image recording apparatus, comprising:

a recording head which discharges a photo curable ink, which is cured by photo irradiation;

a first light irradiating device and a second light irradiating device which irradiate the photo irradiation to the photo curable ink on a recording medium, and each of which includes a light source;

a detector which detects an illumination intensity of each light irradiating device;

a judgment section which judges whether a difference between a first illumination intensity of the first light irradiating device and a second illumination intensity of the second light irradiating device is more than a predetermined value based on a result of detection by the detector or not; and a controller which controls at least one of the first light irradiating device and the second light irradiating device so that the first illumination intensity and the second illumination intensity are substantially or exactly same as each other, when the judgment section judges the difference is more than the predetermined value.

2. The image recording apparatus of claim 1, wherein the first light irradiating device and the second light irradiating device irradiate the photo irradiation with a controlled illumination intensity to the photo curable ink on the recording medium, and the controller controls time duration that the curable ink is irradiated based on the controlled illumination intensity.

3. The image recording apparatus of claim 2, further comprising:

a moving section which moves the recording medium and/or the light irradiating devices relatively, wherein the controller decreases a relative speed by the moving section so as to control the time duration.

4. The image recording apparatus of claim 3, wherein the controller controls the time duration by decreasing a moving speed of the light irradiating devices.

5. The image recording apparatus of claim 3, wherein the controller controls the time duration by decreasing a moving speed of the recording medium.

6. The image recording apparatus of claim 1, wherein the controller controls the first light irradiating device or the second light irradiating device so that a larger illumination intensity in one of the first light irradiating device and the second light irradiating device becomes substantially or exactly same as a lower illumination intensity of other light irradiating device.

7. The image recording apparatus of claim 1, wherein the first and the second light irradiating devices are provided in a direction perpendicular to a direction that the recording medium is relatively moved.

8. The image recording apparatus of claim 1, further comprising:

a warning section which generates an alert to a user, wherein the controller controls the warning section so as to generate the alert to the user, when the judgment section judges the first illumination intensity or the second illumination intensity is lower than a predetermined illumination intensity.

9. The image recording apparatus of claim 1, wherein the controller prohibits an image recording operation of the image recording apparatus, when the judgment section judges the first illumination intensity or the second illumination intensity is lower than a predetermined illumination intensity.

10. The image recording apparatus of claim 1, further comprising:

a third light irradiating device which irradiates the photo curable ink on the recording medium, and includes a light source, wherein the controller controls at least one of the first, the second and the third light irradiating devices so that the first illumination.intensity, the second illumination intensity and a third illumination intensity of the third light irradiating device are substantially or exactly same as each other, when the judgment section judges the difference among them is more than the predetermined value.

11. The image recording apparatus of claim 10, wherein the controller controls at least one of the first, the second and the third light irradiating devices so that largest illumination intensity in one of them becomes substantially or exactly same as lowest illumination intensity of another light irradiating device.

12. An image recording apparatus, comprising:

a recording head which discharges a photo curable ink, which is cured by photo irradiation;

a plurality of light irradiating devices which irradiate the photo irradiation to the photo curable ink on a recording medium, and each of which includes a light source;

a detector which detects an illumination intensity of each light irradiating device;

a controller which controls at least one of the light irradiating devices so that largest illumination intensity in one of the light irradiating devices becomes substantially or exactly same as lowest illumination intensity of another light irradiating device; and a moving section which moves the recording medium and/or the light irradiating devices relatively, wherein the controller decreases a relative speed by the moving section so as to control time duration that the photo curable ink is irradiated.

13. The image recording apparatus of claim 12, wherein the controller controls the time duration by decreasing a moving speed of the light irradiating devices.

14. The image recording apparatus of claim 12, wherein the controller controls the time duration by decreasing a moving speed of the recording medium.

15. The image recording apparatus of claim 12, wherein the light irradiating devices are provided in a direction perpendicular to a direction that the recording medium is relatively moved.

16. The image recording apparatus of claim 12, further comprising:

a warning section which generates an alert to a user, wherein the controller controls the warning section so as to generate the alert to the user, when the judgment section judges one of the light irradiating devices having an illumination intensity which is less than a predetermined illumination intensity exists.

17. The image recording apparatus of claim 12, wherein the controller prohibits an image recording operation of the apparatus, when the judgment section judges one of the light irradiating devices having an illumination intensity which is less than a predetermined illumination intensity exists.

18. An image recording apparatus, comprising:

a recording head which discharges a photo curable ink, which is cured by photo irradiation;

a light irradiating device which irradiates the photo irradiation to the photo curable ink on a recording medium, and includes a plurality of light sources;

a detector which detects an illumination intensity of each of the light sources;

a judgment section which judges whether a difference between the illumination intensities of the light sources are more than a predetermined value based on a result of detection by the detector or not; and a controller which controls at least one of the light sources so that each illumination intensity is substantially or exactly same as each other, when the judgment section judges the difference is more than the predetermined value.

19. The image recording apparatus of claim 18, wherein the irradiating device irradiates the photo irradiation with a controlled illumination intensity to the photo curable ink on the recording medium, and the controller controls time duration that the curable ink is irradiated based on the controlled illumination intensity.

20. The image recording apparatus of claim 19, further comprising:

a moving section which moves the recording medium and/or the light irradiating device relatively, wherein the controller decreases a relative speed by the moving section so as to control the time duration.

21. The image recording apparatus of claim 20, wherein the controller controls the time duration by decreasing a moving speed of the light irradiating device.

22. The image recording apparatus of claim 20, wherein the controller controls the time duration by decreasing a moving speed of the recording medium.

23. The image recording apparatus of claim 18, wherein the controller controls the light irradiating device so that largest illumination intensity in one of the light sources becomes substantially or exactly same as lowest illumination intensity of another light source.

24. The image recording apparatus of claim 18, wherein the light sources are provided in a direction perpendicular to a direction that the recording medium is relatively moved.

25. The image recording apparatus of claim 18, further comprising:

a warning section which generates an alert to a user, wherein the controller controls the warning section so as to generate the alert to the user, when the judgment section judges one of the light source having an illumination intensity which is less than a predetermined illumination intensity exists.

26. The image recording apparatus of claim 18, wherein the controller prohibits an image recording operation of the image recording apparatus, when the judgment section judges one of the light sources having an illumination intensity which is less than a predetermined illumination intensity exists.

27. An image recording apparatus, comprising:

a recording head which discharges a photo curable ink, which is cured by photo irradiation;

a light irradiating device which irradiates the photo irradiation to the photo curable ink on a recording medium, and includes a plurality of light sources;

a detector which detects an illumination intensity of each of the light sources;

a controller which controls at least one of the light sources so that largest illumination intensity in one of the light sources becomes substantially or exactly same as lowest illumination intensity of another light source; and a moving section which moves the recording medium and/or the light irradiating device relatively, wherein the controller decreases a relative speed by the moving section so as to control time duration that the photo curable ink is irradiated.

28. The image recording apparatus of claim 27, wherein the controller controls the time duration by decreasing a moving speed of the light irradiating device.

29. The image recording apparatus of claim 27, wherein the controller controls the time duration by decreasing a moving speed of the recording medium.

30. The image recording apparatus of claim 27, wherein the light sources are provided in a direction perpendicular to a direction that the recording medium is relatively moved.

31. The image recording apparatus of claim 27, further comprising:

a warning section which generates an alert to a user, wherein the controller controls the warning section so as to generate the alert to the user, when the judgment section judges one of the light source having an illumination intensity which is less than a predetermined illumination intensity exists.

32. The image recording apparatus of claim 27, wherein the controller prohibits an image recording operation of the apparatus, when the judgment section judges one of the light sources having an illumination intensity which is less than a predetermined illumination intensity exists.

* * * * *